United States Patent [19]

Aulmann et al.

[11] 4,047,673

[45] Sept. 13, 1977

[54] SINGLE-ROLL CRUSHER

[75] Inventors: Herbert Aulmann, Mullenbach; Ernst Braun; Gert Braun, both of Essen-Heisingen, all of Germany

[73] Assignee: Aulmann & Beckschulte, Bergneustadt, Germany

[21] Appl. No.: 675,502

[22] Filed: Apr. 9, 1976

[30] Foreign Application Priority Data

Apr. 12, 1975 Germany ..... 2516146

[51] Int. Cl.[2] ..... B02C 13/09

[52] U.S. Cl. ..... 241/186 R; 241/189 R; 241/287

[58] Field of Search ..... 241/186 R, 189 R, 189 A, 241/190, 238, 285 R, 287

[56] References Cited

U.S. PATENT DOCUMENTS

| | | | |
|---|---|---|---|
| 2,490,564 | 12/1949 | Vincent | 241/285 R |
| 3,667,694 | 6/1972 | Williams | 241/186 R |
| 3,881,663 | 5/1975 | Brown | 241/285 R X |
| 3,910,510 | 10/1975 | Danberg | 241/189 R |
| 3,934,499 | 1/1976 | Strom | 241/186 R X |

*Primary Examiner*—Roy Lake
*Assistant Examiner*—Howard N. Goldberg
*Attorney, Agent, or Firm*—Karl F. Ross

[57] ABSTRACT

A single-roll crusher has a crushing roll formed with a plurality of hammers and disposed above an anvil or breaker plate which can form the bottom of a trough through which a conveyor passes to carry the material to be crushed into the breaker and the crushed product therefrom. The height of the central portion of the roll above the anvil plate defines the maximum size of the material which can be comminuted. To stabilize the rotation of the roll and yet permit this distance to be relatively great, a pair of massive circular spinning disks are mounted on the roll shaft coaxial with the roll. The disks flank the channel through which the material passes.

10 Claims, 3 Drawing Figures

SINGLE-ROLL CRUSHER

FIELD OF THE INVENTION

The present invention relates to a single-roll crusher for the comminution of large pieces of mineral substances, especially coal or like minerals. More particularly, the invention deals with improvements in stabilizing the operation of a roll of a single-roll crusher for mineral matter.

BACKGROUND OF THE INVENTION

A conventional through-feed single-roll crusher comprises a crusher roll which may be formed with one or more hammers and is journaled for rotation about a horizontal axis at a distance above a breaker or anvil plate across which the mineral substances to be comminuted are passed. The anvil can be formed by the base of a trough through which a flight conveyor passes to entrain the mineral bodies into the path of the hammers and to carry away the comminuted product.

In conventional systems of this type the roll is provided with an eccentric counterweight to counterbalance the hammers. This counterweight lies in the central portion of the roll between the flanks of the channel through which the material is conducted and thus reduces the clearance between the central portion of the roll and the anvil. Since this clearance determines the maximum size of the material which can be handled in the crusher or breaker, the disadvantages of such systems will be apparent.

Furthermore, there have been conventional systems which have been designed to absorb the upwardly directed reaction forces between the upper portion of the crusher and the lower portion thereof with shock absorber acting upon the crusher roll. These shock-damping devices provide a floating support of the upper portion of the crusher and therefore for the crusher roll upon the lower portion.

Such a floating suspension for the roll has been found to be disadvantageous in various respects. Thus, when the stress is applied to the breaker roll somewhat off center, the latter is subjected to uncontrollable transverse forces which result in a wobbling operation of the roll. A corresponding wobbling of the entire upper portion of the crusher, upon which the roll is mounted, also is observed. The rotation of the roll is thus frequently unstable and the crushing efficiency is reduced or the product size will vary.

Finally, it will be apparent that the more cushioning is used in supporting the crusher roll, the softer will be the impact for given parameters of breaker roll operation and hence efficiency falls off with increased cushioning by the shock absorber. The impact of the roll, when the latter is suspended with shock absorbers, must be relatively low in order to prevent high stresses from being applied to the bearings in which the roll is journaled. This again reduces the output and effectiveness of the crusher.

OBJECTS OF THE INVENTION

It is the principal object of the present invention to provide an improved single-roll crusher in which the aforedescribed disadvantages are avoided.

Another object of the invention is to provide a single-roll crusher in which the upper portion of the crusher need not be suspended by shock dampers or the shock absorber mounting of the roll can be eliminated or minimized.

Still another object of the invention is to provide a single-roll crusher capable of processing materials of large size without the disadvantages of the earlier systems mentioned above.

SUMMARY OF THE INVENTION

These objects and others which will become apparent hereinafter are attained, in accordance with the present invention, in a single-roll crusher in which the roll shaft forms the axis of rotation, a pair of massive circular spinning disks which flank the hammers of the roll in the region of the shaft ends.

According to the invention, therefore, a single-roll crusher comprises a housing, a bifurcated support swingably mounted on the housing about a horizontal axis and formed with the trunnions for a crusher roll, a crusher roll journaled in these bearings about a horizontal axis spaced from the pivot axis of the bifurcated support so that as the free extremities of the arms of the bifurcated support are raised and lowered, the height of the roll axis is correspondingly varied, an anvil disposed below the crusher roll at a distance therefrom which varies in dependence upon the position of the roll axis, a conveyor traveling along the anvil for entraining large pieces of coal or other mineral into the housing and past the roll and carrying the comminuted product out of the housing which forms a trough having an anvil as its floor, and a pair of circular disks forming flywheels at each end of the hammer portion of the crusher roll. Advantageously, these disks have a mass which is a substantial fraction of the mass of the roll, e.g. between 5 and 80% of the mass of the roll.

According to a feature of the invention, the crusher roll is provided with a central portion having a plurality of hammers projecting outwardly from the periphery of the central portion and engageable with the mineral matter in the channel defined between the inwardly facing surfaces of the aforedescribed disks.

This arrangement has the advantage that it eliminates the need for eccentric counterweights and shock-absorber supports for the crusher roll and nevertheless allows the throat of the machine, as measured between the central portion of the roll and the anvil, to be considerable and thereby enabling large pieces to be processed with ease. Furthermore, the impact circle diameter can be substantially larger than in conventional systems.

These advantages are obtained because the outwardly disposed circular diskks on the one hand resist the upwardly directed reaction forces applied to the crusher roll and, on the other hand, because of their high moments of inertia increase the impact energy and positional stability of the crusher roll.

The rotating masses formed by the disks can be used fully to store energy which is converted into impact energy in accordance with flywheel principles. Since the large masses of these disks are located at the ends of the shaft, even noncentral forces applied to the roll do not adversely affect its stability.

Because the disks are located at the outer ends of the roll and immediately adjacent the support bearings or trunnions, there is a minimum loading of the latter. Any stresses developed between the hammers and the disks are absorbed within the central portion of the roll and are not transferred to the crusher housing. Damage to the crusher housing is thereby precluded. The machine can therefore be described as a circular disk breaker.

According to another feature of this invention, the two outwardly disposed circular disks define the lateral flanks of the channel through which the mineral material is passed. In this case the disks not only protect the lateral walls of the housing, but since they rotate in the direction of movement of the materials they reduce the frictional drag on the material which otherwise would be applied by the housing and increase the throughput through the system.

Advantageously the lateral walls of the housing are provided with guide slots through which the shaft of the crusher roll extends and in which the shaft is permitted to move on the bifurcated support. The circular disks overlie these slots and prevent escape of the comminuted material.

It has been found to be advantageous to have the diameter of the circular disks at least equal to the impact-circle diameter so that the circular disks constitute a large rotating mass. In this respect it should be noted that the most preferred condition has the circular disk diameter equal to the diameter of the impact circle defined by the hammers on the roll.

According to yet another feature of the invention, the hammers of the roll are constituted as disk segments with heads mounted at the ends of the respective segments, the segments being provided in pairs which are offset by 180° from one another about the axis of the crusher-roll shaft. This balances each hammer with another. Between hammer segments we provide spacer rings which are exchangeable, interchangeable or replaceable to vary the spacing and positions of the hammers or pairs of hammers.

The free ends of the arms of the bifurcated support are vertically adjustable by means of piston-and-cylinder devices which can be connected to a height adjustment mechanism for varying the throat of the machine as measured between the central portion of the crusher roll and the anvil plate.

The system has the advantage that it permits the central portion of the crusher roll to be of relatively small diameter and yet have a large impact-circle diameter so that the capacity of the machine or large bodies is increased. The upwardly directed reaction forces are taken up by the circular disks and the latter also enhance the deliverable impact energy. A maximum output is achieved with a minimum of energy input. The system can be automatically adjusted to accommodate larger or smaller pieces of the mineral and is generally simpler and more efficient than earlier systems.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
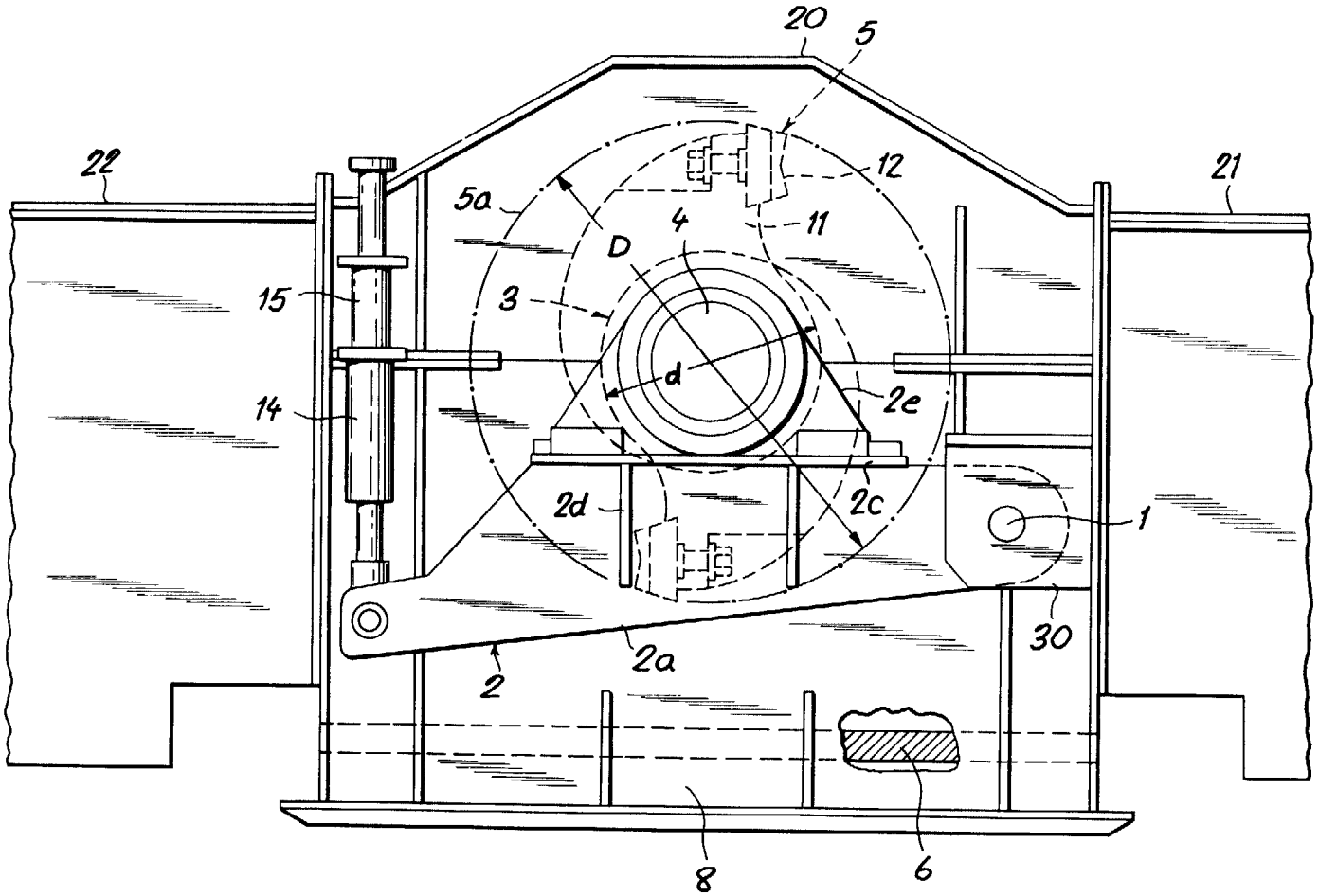
FIG. 1 is a front-elevational view, partly in diagrammatic form, of a single-roll crusher according to the invention.
Figure 2:
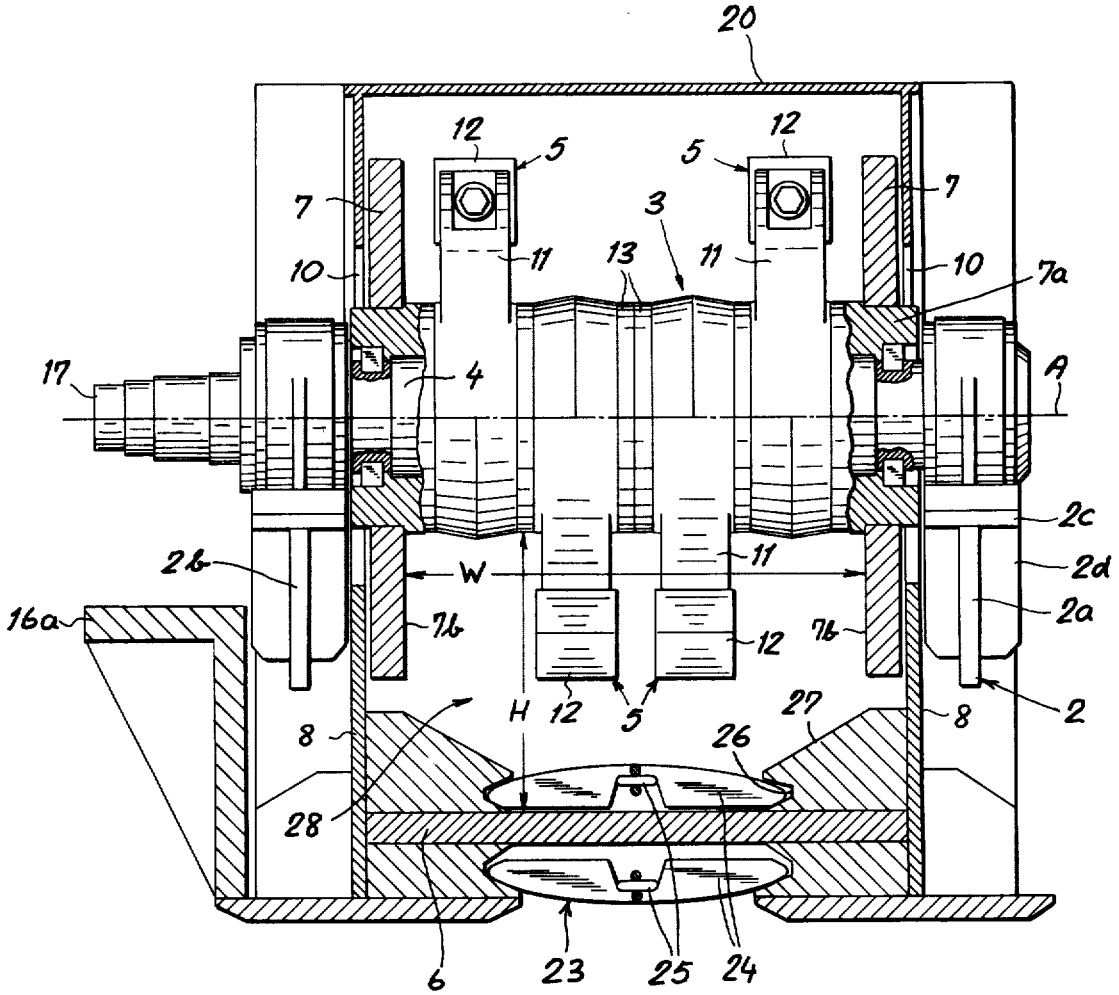
FIG. 2 is a side-elevational view, partly broken away, of the crusher.
Figure 3:
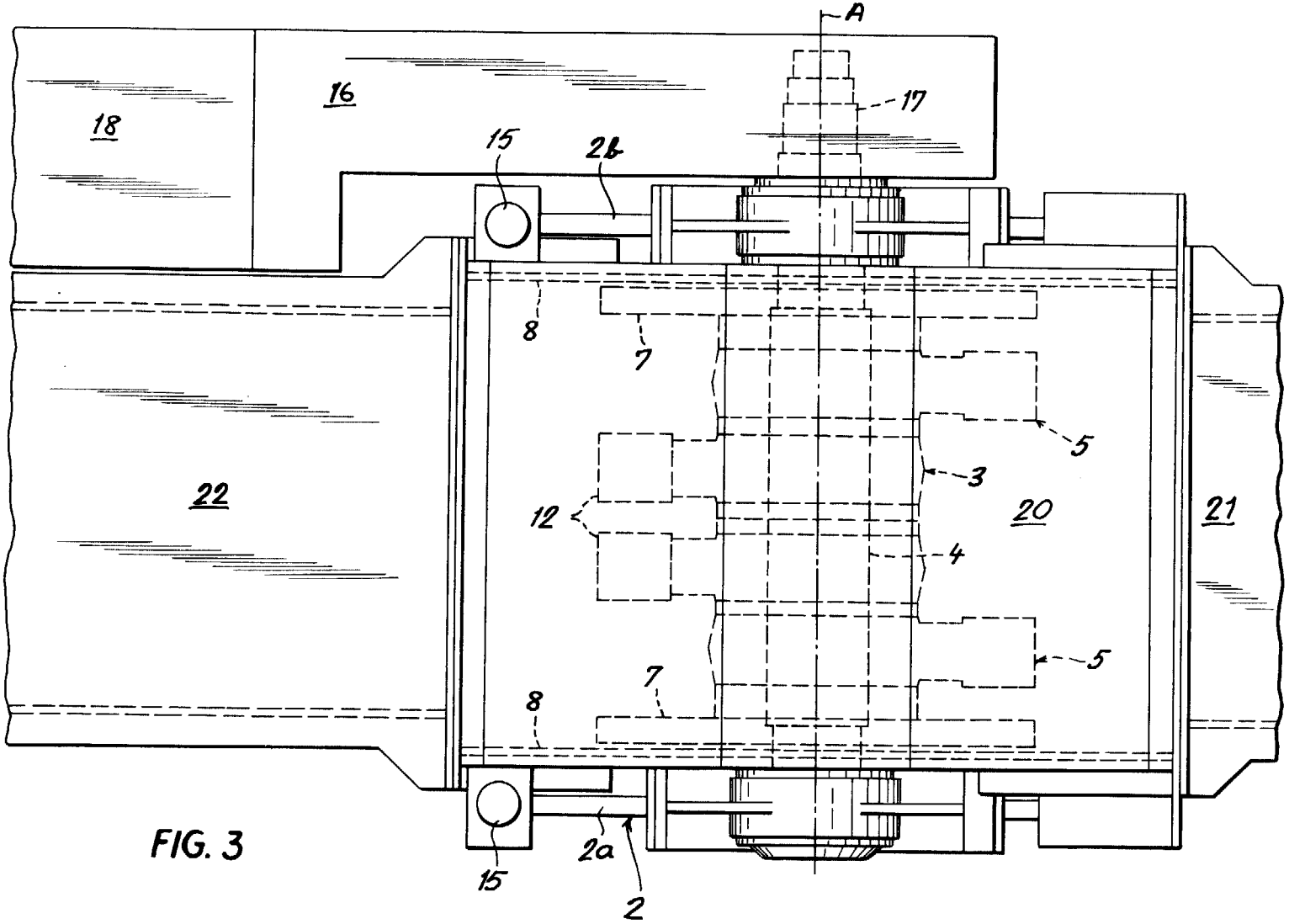
FIG. 3 is a plan view of the crusher of FIGS. 1 and 2.

In the drawing we show a single-roll crusher which comprises a housing 20 formed with an inlet side 21 and an outlet side 22 and traversed by a chain flight conveyor represented at 23. This conveyor comprises flights 24 which are entrained by a chain 25 along opposite surfaces of an anvil plate 6 mounted between the lateral walls 8 of the housing 20. The ends of flights 24 are guided in grooves 26 of guide bodies 27 which form a channel 28 for the material to be comminuted. This channel has an effective width W and an effective height H as will be described in more detail below.

The housing 20 is formed with reinforced supports 30 for a shaft 1 defining the pivot axis for a bifurcated support 2. The support 2 has arms **2*a* and 2*b*, each arm carrying a pedestal 2*c* secured by reinforcing ribs 2*d* and mounting respective journal blocks 2*e* forming trunnions for a breaker shaft 4. The shaft 4 extends horizontally through the housing and is formed therein with a crusher roll 3** having an effective roll diameter *d*.

The crusher roll 3 is formed by a plurality of hammers 5 separated by one or more spacer disks 13, the latter being replaceable and exchangeable so that the positions of the hammers 5 can be varied. The hammers sweep through an impact circle **5*a*** having a diameter D.

The distance of the crusher roll 3 above the anvil plate 6 determines the throat height H for the mineral matter to be comminuted and hence the maximum size of the pieces to be handled.

The breaker shaft 4 forms the axis for a pair of rotating circular disks 7 constituting flywheels and keyed to hubs **7*a* which in turn are keyed to the shaft 4, the hubs 7*a* forming part of the crusher roll 3. The disks 7 are disposed at the outer ends of the crusher roll within the housing and thus flank the array of hammers 5. The inner faces 7*b* of the disk 7** define the width W of the channel through which the mineral material is displaced.

Between the arms **2*a* and 2*b* of the bifurcated support 2 and the respective spinning disks 7, the side walls 8 of the housing 20 are formed with guide slots 10 through which the shaft 4 passes and which allows the vertical adjustment of the axis A of the roll with respect to the anvil 6**.

The disks 7 have a diameter substantially larger than the lengths of the slots 10 so that they completely overlie these slots in all positions of the crusher roll and prevent escape of the comminuted material through these slots. In the embodiment illustrated and in the preferred construction, the diameters of the disks 7 correspond to the impact circle diameter D.

The hammers 5 are constituted as disk segments 11 with hammerheads 12 and are disposed in pairs with the segments of each pair offset through 180° about the axis A.

The bifurcated support 2 is provided at the free ends of the arms **2*a*, 2*b* with fluid-responsive piston-cylinder arrangements 14 which may be vertical adjustments of the roll 3. Each of the arrangements 14 is connected to a height adjustment device 15 (see FIG. 1). For an especially compact construction of the system, a pedestal 16*a* is provided to carry a flat transmission 16 running from the motor unit 18 and operating the drive stub 17 of shaft 4** via V-belts and pulleys not shown.

We claim:

1. A single-roll crusher, especially for coal and similar minerals, comprising a housing, a bifurcated support pivotally mounted on said housing, a crusher roll journaled on said support and provided with a plurality of hammers, an anvil plate disposed below said crusher roll and cooperating with said hammers to comminute mineral pieces passing through a throad between said roll and said anvil plate, and a pair of rotating disks mounted on the extremities of said roll and flanking said hammers, said roll having a shaft journaled on said support and forming the axis for said disks, said disks resisting upward forces on said roll and imparting thereto a moment of inertia positionally stabilizing same.

2. The single-roll crusher defined in claim 1 wherein said disks define the lateral width of said throat and the distance between said roll intermediate said disks and said plate is the height of said throat.

3. The single-roll crusher defined in claim 1 wherein said housing encloses said roll and has a pair of lateral walls, said lateral walls being disposed between respective arms of said bifurcated support and a respective one of said disks, said lateral walls being formed with guide slots traversed by said shaft and enabling the vertical displacement thereof, said disks covering said slots and preventing the escape of comminuted material therethrough.

4. The single-roll crusher defined in claim 3 wherein said hammers define an impact circle diameter and said disks have diameters at least equal to said impact circle diameter.

5. The single-roll crusher defined in claim 4 wherein each of said hammers is formed as a disk segment, said segments being disposed in pairs offset by 180° about the axis of said shaft.

6. The single-roll crusher defined in claim 5, further comprising spacer rings separating said segments from one another.

7. The single-roll crusher defined in claim 6 wherein said disks together have a mass of 5 to 80% of the total mass of said roll.

8. The single-roll crusher defined in claim 7 wherein said anvil forms the base of a channel, said crusher further comprising a flight conveyor for displacing mineral pieces along said anvil plate through said channel.

9. The single-roll crusher defined in claim 8 wherein said support has a pair of arms each provided with a respective journal block and rotatably supporting an end of said shaft, said disks being disposed proximal to said journal blocks.

10. The single-roll crusher defined in claim 9, further comprising respective height adjustment means engaging each of said arms.

* * * * *